United States Patent [19]

Meyer et al.

[11] 3,935,943

[45] Feb. 3, 1976

[54] SEALED CARTON FORMED FROM A PAIR OF COOPERATING MEMBERS

[75] Inventors: Melvin H. Meyer, Maywood, Ill.; James L. Vickers, Harbert, Mich.; Edmund A. Waycie, River Forest; Gerald Weitzel, Oak Lawn, both of Ill.

[73] Assignee: Stone Container Corporation, Chicago, Ill.

[22] Filed: May 3, 1974

[21] Appl. No.: 466,731

[52] U.S. Cl. ..... 206/45.34; 220/DIG. 22; 220/4 E; 229/23 R

[51] Int. Cl.[2] ..... B65D 25/00; B65D 7/00

[58] Field of Search ..... 220/4 E, DIG. 22; 206/45.34; 229/23

[56] References Cited

UNITED STATES PATENTS 3,608,705 9/1971 Moshel ..... 206/45.34

FOREIGN PATENTS OR APPLICATIONS 18,805 8/1934 Australia ..... 206/45.34

2,036,632 12/1970 France ..... 206/45.34

*Primary Examiner*—Donald F. Norton
*Assistant Examiner*—Douglas B. Farrow
*Attorney, Agent, or Firm*—Silverman & Cass, Ltd.

[57] ABSTRACT

A sealed carton containing lading assembled from a pair of cooperating sheet members comprising a body blank and a cover sheet. The body blank comprises a generally U-shaped formation formed from paperboard or like relatively rigid but foldable material. The cover member is formed from a continuous rectangular sheet member of lightweight, highly flexible material which is substantially thinner than the body blank materail. The body blank has a plurality of hingedly connected flanges folded to positions normal to the panels thereof and the sheet member is folded into a complementary U-formation and matingly engaged over the body blank with marginal edges of the sheet member adhesively secured to said flanges to form the sealed carton around the lading.

8 Claims, 9 Drawing Figures

SEALED CARTON FORMED FROM A PAIR OF COOPERATING MEMBERS

CROSS-REFERENCE TO RELATED APPLICATIONS

The subject matter of this application is related to subject matter disclosed in co-pending patent application, Ser. No. 285,211 filed Aug. 31, 1972 for the invention entitled "METHOD FOR FORMING A PACKAGE" and co-pending Pat. application Ser. No. 446,124 filed Feb. 27, 1974, for the invention entitled "PACKAGING MACHINE USING TWO BLANK CARTON SYSTEM." These patent applications are owned by the same assignee.

BACKGROUND OF THE INVENTION

This invention relates to a novel sealed carton assembled from a pair of sheet members of substantially different physical character, the carton being of the type formed from a two-piece blank system as disclosed generally in said Pat. application Ser. No. 285,211, filed Aug. 31, 1972 and in U.S. Pat. No. 3,622,063.

U.S. Pat. No. 3,622,063 discloses a sealed carton of the general type with which this invention is concerned formed of two pre-cut blanks of double-faced corrugated paperboard material. U.S. Pat. No. 3,704,823 discloses a carton made from a single blank of double-faced corrugated paperboard having a crate-like shape, the top and ends thereof being open and having overlapping flanges to strengthen and rigidify the carton.

The carton system embodying this invention differs from the heretofore mentioned prior art. Said system utilizes only one blank made of corrugated paperboard and a cover member of lightweight, flexible sheet material substituted for the second blank of corrugated paperboard taught by the prior art. With this construction, a carton which is significantly reduced in weight and cost is obtained which provides unusual and unexpected strength and protection for lading sealed therein. Said carton system contemplates also the feasibility of using cover sheet materials of different character, such as kraft paper or transparent or translucent plastic which would enable a display carton to be realized within the purview of the invention, all without sacrificing desirable strength for shipping, storage and stacking purposes.

The sealed carton embodying the invention is further characterized by the use of two blank members formed of substantially different web materials which are suitable for use with automatic packaging machines which wrap the blank members around the lading to be packaged and discharge a sealed package or carton containing the lading. Thus, the unexpected strength, visual packaging features and material cost economies realized from the two-piece carton system embodying the invention are further enchanced in terms of marketability by the ability of said carton system to be used in automatic packaging machinery. Reference to U.S. Pat. Nos. 3,531,914 and 3,665,675 is directed for examples of such automatic packaging machines.

SUMMARY OF THE INVENTION

According to the invention, there is provided a sealed carton containing lading, said carton formed from a foldable paperboard body blank member and a cover sheet member, said body blank being rectangular and folded transverse to its longer dimension into a generally U-shaped formation defined by a center panel and alternate side panels having flanges along the longitudinal side edges and the transverse end edges of said blank, said lading being retained partially surrounded in said formation with the flanges folded inwardly to a position generally perpendicular to the respectively associated panels overlying said lading, and said cover sheet member being of a very thin, lightweight, flexible material folded into a complementary U-shaped formation secured to and overlying the flanges to form a sealed carton encasing said lading between said members.

DESCRIPTION OF THE PREFERRED EMBODIMENTS

Figure 1:
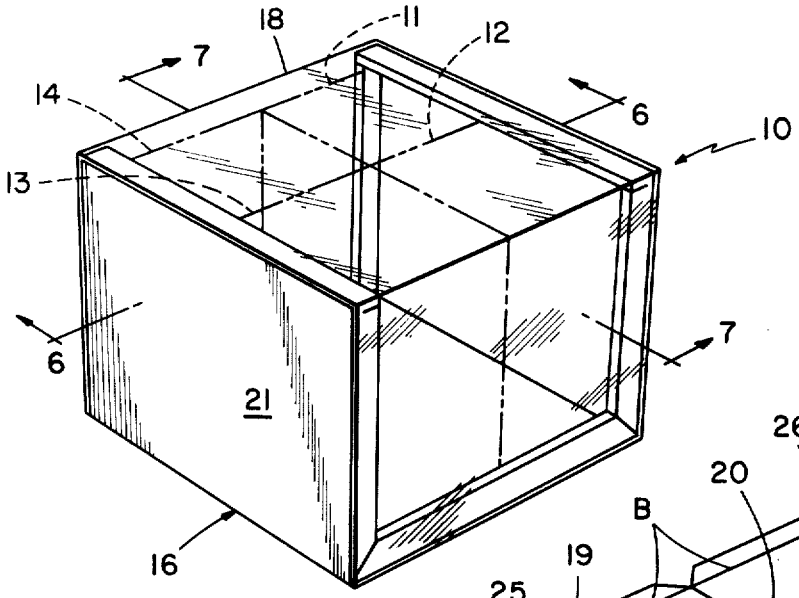
FIG. 1 is a perspective view of one embodiment of the sealed carton embodying the invention.

Referring to FIG. 1, the sealed carton embodying the invention is designated generally by the reference numeral 10 and packets of goods or lading 11, 12, 13 and 14 are shown sealed in the carton 10. Said carton 10 is formed from a two-piece system comprising a folded body blank 16 and a folded cover sheet 18 assembled and secured.

Figure 2:
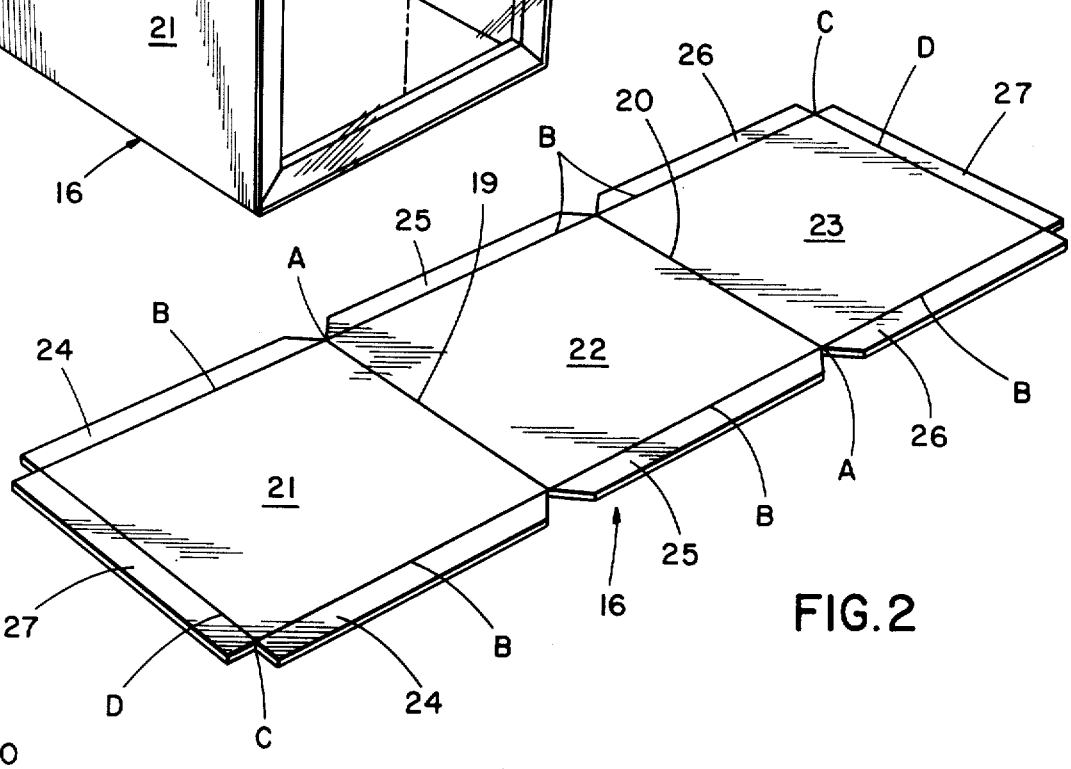
FIG. 2 is a perspective plan view of the body blank member employed in forming the carton of FIG. 1.

Prior to folding thereof, the blank 16 has a generally rectangular, flat configuration die-cut from a web of stock material, such as paperboard, corrugated paper or the like, as shown in FIG. 2. The blank 16 has a pair of transverse fold lines 19 and 20 which define three panels 21, 22, 23. Panel 22 forms a center panel and panels 21 and 23 are hingedly connected on opposite sides of panel 22 along said fold lines 19 and 20 to define alternate side panels. A plurality of flanges are hingedly connected along the perimeter of said blank 16. More specifically, along the opposing longitudinal side edges A of the blank 16 are three pairs of flanges 24, 25 and 26 hingedly connected respectively along suitable fold lines B to panels 21, 22 and 23. Along the opposite transverse end edges C of the blank 16 are two end flanges hingedly connected respectively along suitable fold lines D to the panels 21 and 23.

Figure 3:
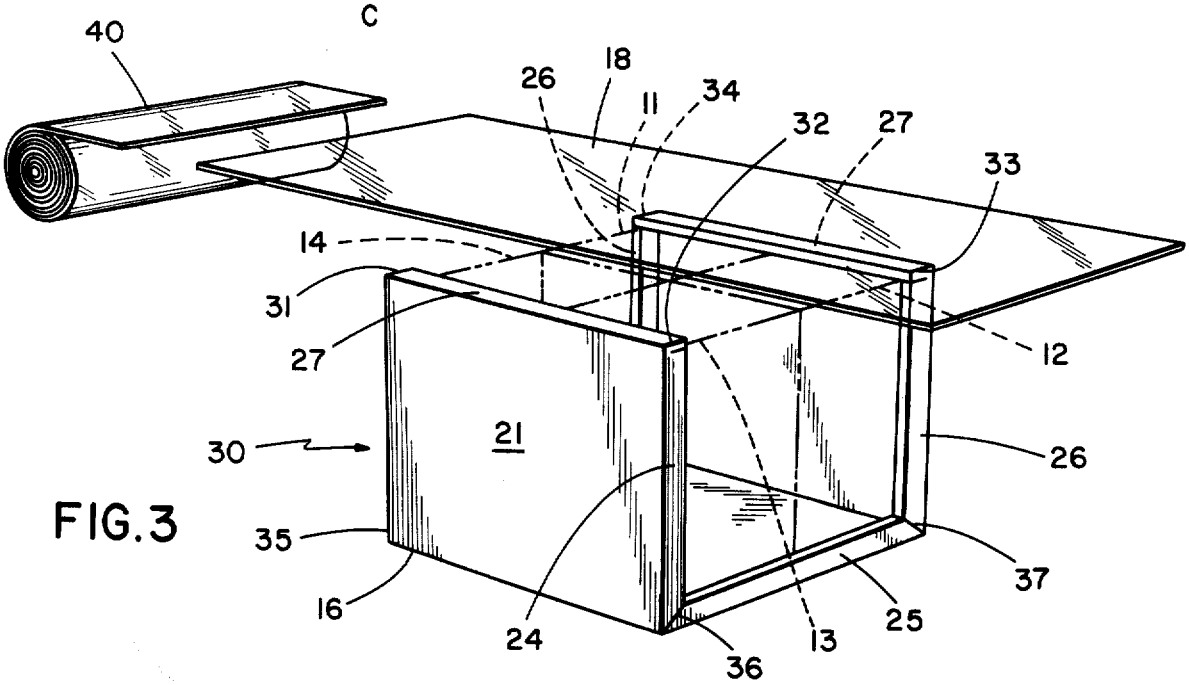
FIG. 3 is a perspective view of the body blank folded into a U-shaped formation partially surrounding lading to be packaged and a cover sheet member poised for securement to said formation preparatory to completing the carton of FIG. 1, and further, showing the cover sheet as having been stripped from a roll of sheet material.

Referring to FIG. 3 showing the manner of assembling the carton 10, the blank 16 preliminarily is folded into a generally U-shape formation 30 partially around packets of lading 11 – 14 and flanges 24 – 27 are folded inwardly to a position generally perpendicular to the associated panel to which it is hingedly connected and overlying said packets. It will be noted that the thusly folded flanges 24 and 27 on one side of the formation 30 form two corners 31 and 32 at the top of the formation which enclose and protect top edges of the packets 13 and 14. Likewise, the thusly folded flanges 26 and 27 on the other side of the formation 30 form corners 33 and 34 which protect the top edges of the packets 11 and 12. Further, panels 21, 22 and 23 and flanges 24, 25 and 26 form bottom corners of formation 30, three corners 35, 36 and 37 being shown in FIG. 3 which serve to protect packets 11 – 14. Thus, the formation 30 formed from the body blank 16 provides packet protection at all eight corners of the completed carton.

After the blank 16 has been folded into the formation 30 shown in FIG. 3, a cover sheet member 18 is poised above the formation 30 with its medial body area overlying the open top of said formation and aligned with the folded end flanges 27. Instead of positioning the cover sheet 18 poised above formation 30, the formation 30 can be moved into position below the cover sheet 18. The cover sheet 18 then is folded around formation 30 so that the inner-facing margin of sheet 18 is engaged in face-to-face contact with the outwardly facing surfaces of flanges 24 – 27 and adhesively secured thereto. For this purpose, adhesive can be applied either to the inner facing margin of cover sheet 18 or to the outwardly facing surfaces of flanges 24 – 27 prior to folding of cover sheet 18. During assembly of the carton 10, pressure preferably is applied at least against the sheet 18 to hold same against the flanges 24 – 27 while the adhesive therebetween sets.

In FIG. 3, the cover sheet 18 is shown as a transparent plastic film supplied from a roll 40 of the film. The cover sheet 18 can be kraft paper or other suitable thin, flexible lightweight sheet material which has been precut and dispensed from a magazine, as distinguished from the continuous web of material represented by roll 40. Kraft paper having a thickness of between 0.003 and 0.010 inches has been used successfully in making carton 10. Other paper material having a thickness between 0.08 and 0.030 can also be used.

Figure 5:
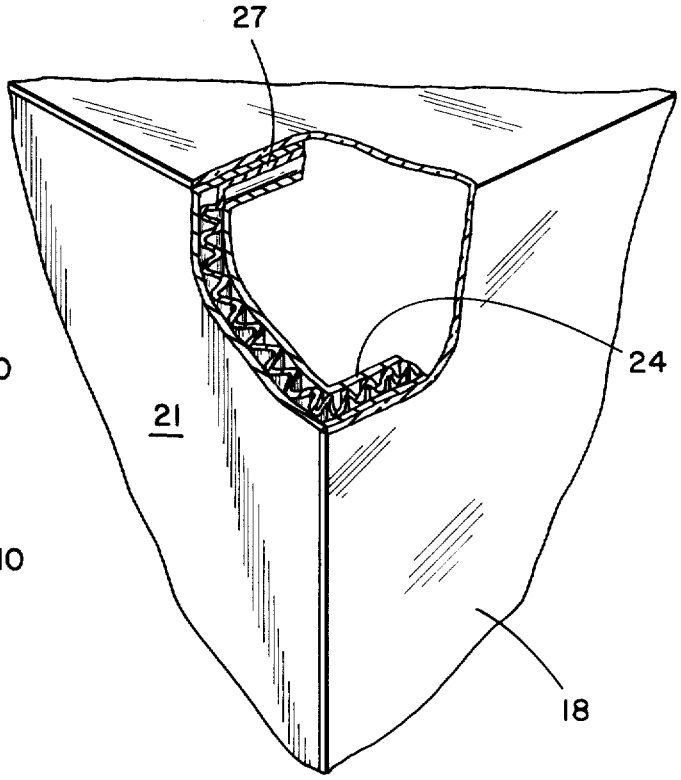
FIG. 5 is a fragmentary perspective view of a corner of said carton of FIG. 1 with portions broken away to show structural details.
Figure 6:
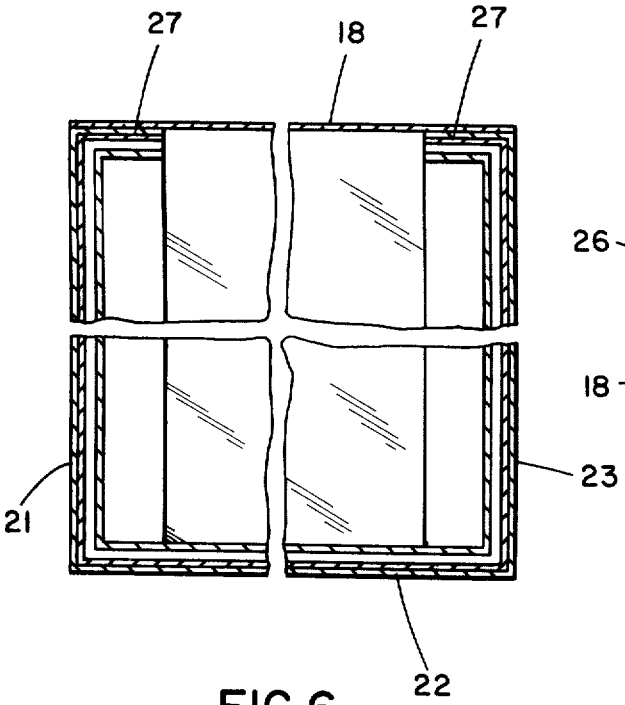
FIG. 6 is a fragmentary sectional view taken along line 6—6 of FIG. 1 and in the general direction indicated.
Figure 7:
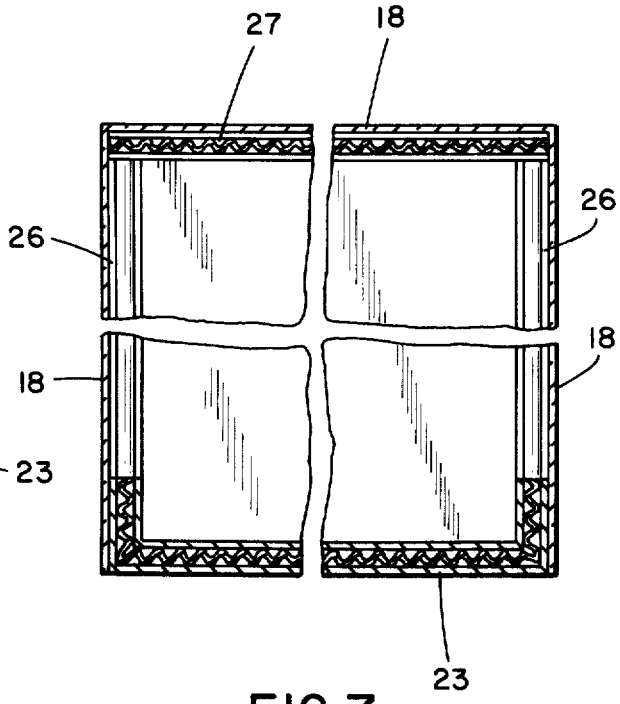
FIG. 7 is a fragmentary sectional view taken along line 7—7 of the FIG. 1 and in the general direction indicated.

As shown in FIGS. 5, 6 and 7, the body blank 16 is made from double faced corrugated paper board. It is contemplated that chipboard or other foldable, paperboard material may be used.

Figure 4:
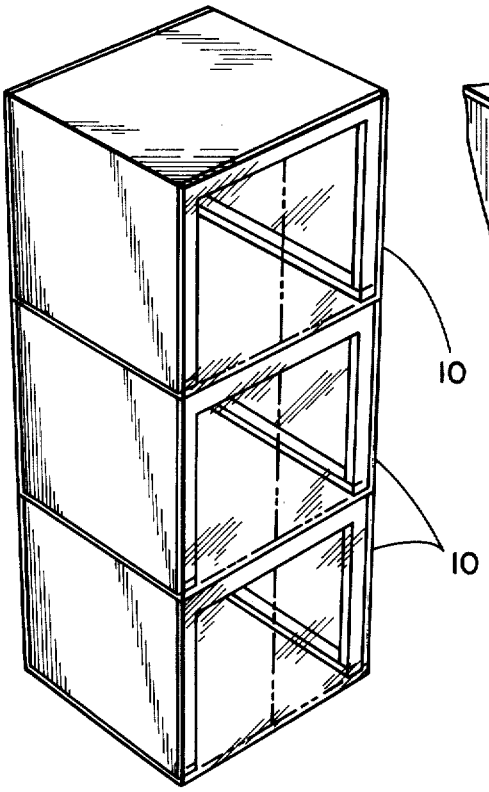
FIG. 4 is a perspective view of a plurality of such sealed cartons inverted and stacked to display the unexpected and unusual strength of said carton.

The sealed carton 10 achieves significant savings in weight and cost of materials without sacrificing strength. Cover sheet 18 holds the flanges 24 – 27 folded over into the position forming the corners 31 – 37 whereby the packets of lading are protected on all corners and on six out of eight edges of the carton 10. Moreover, when the cover sheet 18 comprises a transparent, plastic film, package 10 can function also as a display package which reveals the contents of the package. Additionally, it has been found that the stacking strength of carton is not impaired so that cartons 10 can be inverted from the orientation thereof shown in FIG. 1 and stacked, as shown in FIG. 4.

In comparative tests made between a conventional wrap-around type package made from a single paperboard blank and a carton 10 of the same size and configuration, carton 10 used only 44 percent of the corrugated fibreboard material used in such conventional package and yet, had 66 percent of the compression strength of such conventional package. Also, carton 10, by reason of the corners 31 – 37, afforded edge drop protection equivalent to the protection obtained with a conventional package. Additionally, it was found that cartons 10 using cover sheets of kraft paper were stronger than cartons using cover sheets of polyethylene or similar plastic film. This is attributed to the lack of rigidity of the film, i.e., it has some elasticity, as opposed to the relative rigidity of the kraft paper after it is folded and secured in place on a formation 30.

An important feature of the invention resides in the ability to use automatic packaging machinery with the two-piece system of carton 10. The related patent application referenced herein discloses a method of forming a sealed carton by wrapping a blank, such as body blank 16, partially around lading when a U-shaped formation such as formation 30 is formed. Thereafter, the cover sheet 18 can be folded over the three open sides of the U-formation 30 to enclose the lading. Adhesively securing the cover sheet 30 to the flanges 24, 25, 26 and 27 forms the sealed carton 10 and this still can be done in automatic packaging equipment of the general type disclosed in said U.S. Pat. Nos. 3,531,914 and 3,665,675.

It will be noted that for a cubical carton the body blank 16 and cover sheet 18 are substantially equal in length so that their engagement one with the other to form carton 10 results in flush edges and no outwardly extending parts. The same width of sheet 18 and body blank 16, excluding the flanges, also contributes to this result. In all cases, the cover sheet, being highly flexible, can be tightly folded or wrapped around the formation 30 and secured to the flanges to form a neat, compact and tight package or carton 10.

Figure 8:
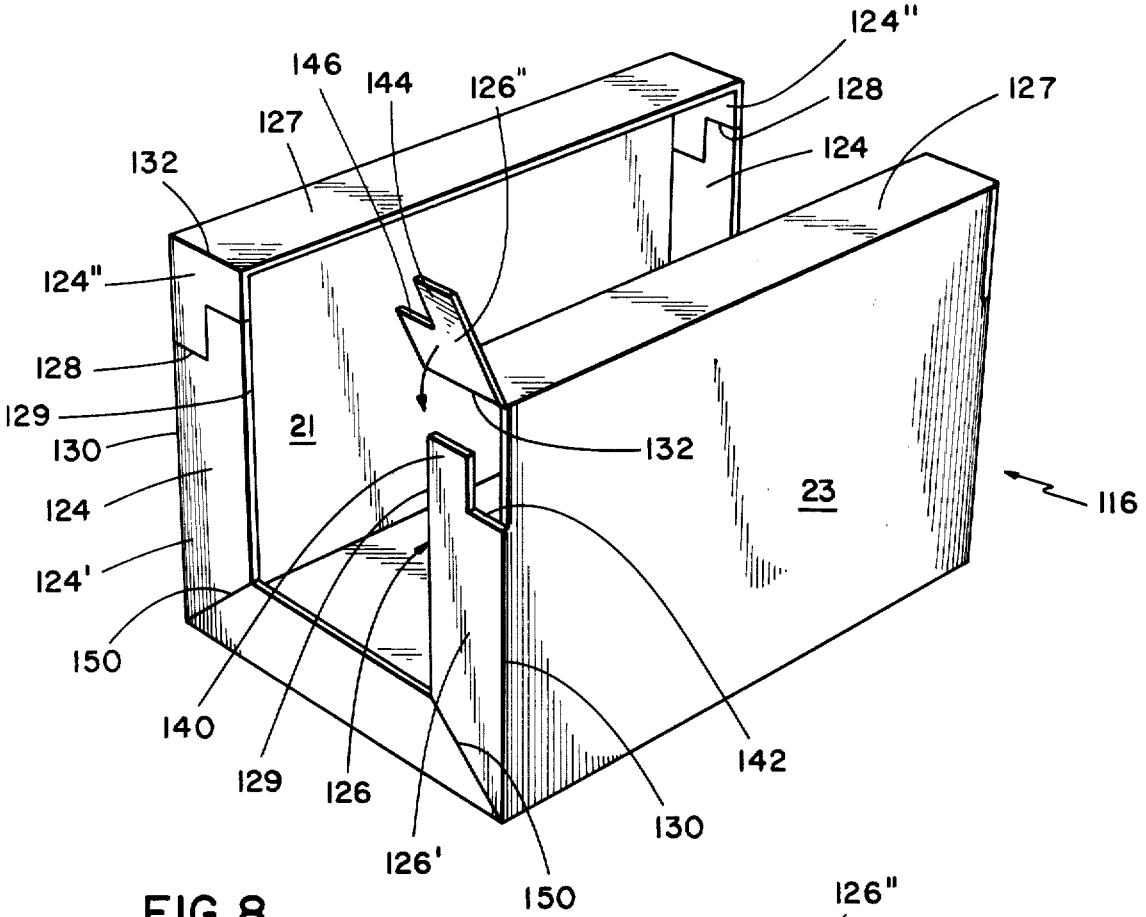
FIG. 8 is a perspective view of the folded body blank of another embodiment of the sealed carton.
Figure 9:
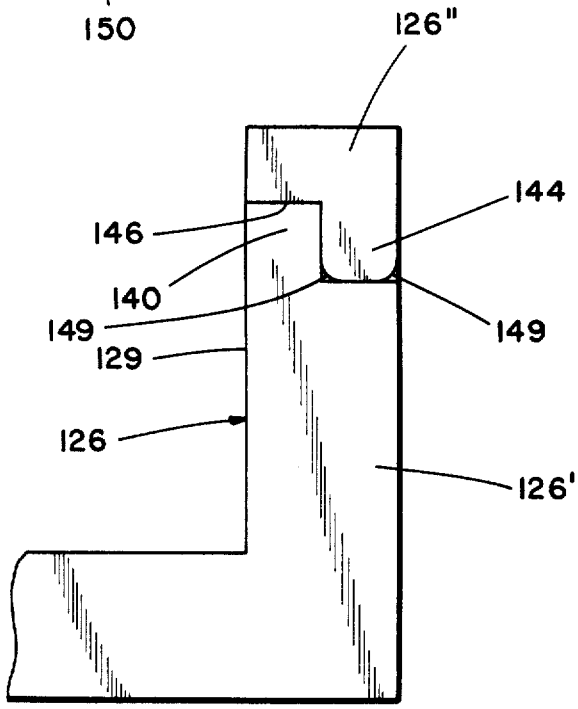
FIG. 9 is a fragmentary end view of the body blank shown in FIG. 8.

Illustrated in FIGS. 8 and 9 is a modified body blank designated 116. Blank 116 has side flanges 124 and 126, there being a pair of such side flanges for the body blank. These flanges 124 and 126 are shorter than the corresponding flanges 24 and 26 of the blank 16. Blank 116 also has a pair of end flanges 127 which connect with flanges 124 and 126, respectively. Each flange 124 and 126 has a step-shaped slit 128 extending from a free edge 129 thereof transverse to the length of the flange across its width to the fold line 130 which joins the flange to a panel 21 or 23 of the body blank. The slit 128 serves to separate each flange 124 and 126 into a pair of segments designated 124' and 124'' and 126' and 126'', respectively. As seen in FIG. 8, the segments 124'' and 126'' are the shorter of the two parts and are hinged to an end flange 127 along the fold line 132.

As seen in FIG. 8, slit 128 serves to provide an upwardly extending tab 140 and a U-shaped notch 142 on each side flange. The segments 124'' and 126'' also have tabs 144 designed to engage in the notches 142 with tab 140 accommodated in the notch 146. The corners 149 of the tabs 144 are rounded or have a radius for facilitating interengagement of tabs 144 in notches 142.

Referring to FIG. 9, the segments 124'' and 126'' are shown frictionally engaged with the segments 124' and 126', respectively, to form the continuous side flanges 124 and 126. However, by forming side flanges 124 and 126 in two segments, as discussed above, mating engagement of the segments 124' and 124'' and 126' and 126'' in a friction fit serves to prevent buckling or spreading outwardly of flanges 124 and 126 relative to the panels of the body blank. In other words, the flange construction described comprise tab lock means which serve to help maintain flanges 124 and 126 normal to the panels of the body blank 116 for a sufficient time period so that the second blank can be installed. It seems that the engagement of side flanges 124 and 126 at the miter joint 150 seen in FIG. 8 is not sufficient to maintain the desired orientation of the flanges 124 and 126 normal to the body blank panels 21, 23 so that the second sheet member can be installed in automatic packaging equipment most efficiently and speedily.

It is emphasized that the slit 128 does give rise to a slight friction fit between segment 124' and 124'' and 126' and 126'' so as to hold side flanges 124 and 126 normal to the side panels of the body blank as seen in FIG. 8. Although slit 128 has been illustrated as step-shaped, other configurations are suitable, although not optimum in character. A key-hole shaped slit formation was utilized with advantage, but was found not to be as convenient. The same applies to a tongue and groove arrangement and dovetail joint. The step-formation slit 128 was found to be the best.

It will be apparent to those skilled in the art that obvious modifications can be made to the package 10 without departing from the spirit or scope of the invention as defined in the appended claims.

We claim:

1. A sealed carton containing lading and formed from a pair of cooperatively engaged members comprising, a pre-cut body blank member of foldable, paperboard material and a cover sheet member formed of a flexible, lightweight material, said body blank having a pair of spaced apart lines of fold transverse to the longitudinal axis of the blank to provide a center panel and a pair of side panels hingedly connected along a pair of opposite side edges of the center panel, said body blank being folded into an upwardly opening generally U-shaped formation, said panels having hinged flanges along the longitudinal side edges and transverse end edges thereof folded inwardly to a position normal to the plane of the respective panel to which they are hinged, said cover sheet being folded into a downwardly opening U-shaped formation complementary to the first mentioned formation and matingly engaged tightly thereover, said cover sheet being secured to said flanges along the length of said body blank to seal the lading in the thusly formed carton, each of said transverse end flanges having a flap extending outwardly from each side thereof and each of the side flanges hingedly connected to one of the side panels being shorter in length than the side panel to which it is connected, each flap being folded to extend downwardly into the space not occupied by the shorter flanges and the mating side edges of each flap and each side flange being irregular in shape and frictionally engaging each other thereby to inhibit outward movement of the shorter side flanges from the folded body blank prior to the folding of the cover sheet thereabout.

2. The carton according to claim 1 wherein said cover sheet is made of kraft paper.

3. The carton according to claim 1 wherein said cover sheet is made of a paper material having a thickness between 0.003 and 0.030 inches.

4. The carton according to claim 1 wherein said cover sheet is made from a plastic film.

5. The carton according to claim 1 wherein said cover sheet is made of polyethylene film.

6. The carton according to claim 4 wherein said plastic film is transparent.

7. The carton according to claim 1 wherein said irregular shape of each said mating flap edge and side flange edge is a step formation, the step formation on the side flange edge being defined by an upwardly extending tab spaced outwardly from the side panel to which said flange is attached with a notch formed therebetween and the step formation on the flap edge being defined by a tab and a shoulder, said tab of said flap having rounded corners, and said tab and shoulder of each flap engaging mating with said notch and tab of said side flange, respectively.

8. A sealed carton containing lading and formed from a pair of cooperatively engaged members comprising, a pre-cut body blank member of foldable, structurally stable, load accommodating paperboard material and a cover sheet member formed of a flexible, very thin lightweight material capable of principally accommodating only tension stress in the plane thereof, said body blank having a pair of spaced apart lines of fold transverse to the longitudinal axis of the blank to provide a center panel and a pair of side panels hingedly connected along a pair of opposite side edges of the center panel, said body blank being folded into an upwardly opening generally U-shaped formation, each of said panels having hinged flanges along the opposite side edges thereof which are formed from the longitudinal edges of said body blank, the center panel flanges comprising end flanges, and said side panels additionally having outer transverse end edges with hinged flanges therealong, each flange being folded inwardly to a position normal to the plane of the respective panel to which it is hinged with the center panel flange ends abutting the contiguous side panel flange ends in cooperative supporting engagement, said lading being disposed on said center panel and having a configuration substantially filling said carton and supporting the side panels from the interior thereof, said cover sheet being folded into a downwardly opening U-shaped formation complementary to the first mentioned formation and matingly engaged tightly thereover, said cover sheet having its margin along opposite longitudinal edges coextensive with and adhesively secured in face-to-face overlying relation to those of said flanges which are connected to said side panels of said body blank to tie the side panels together in tension at their sides and across their transverse end edges, and the cover sheet also having its margin along its opposite end edges coextensive with and adhesively secured in face-to-face overlying relation to said end flanges of the center panel to dispose said flanges in supporting position between said side panels at the bottom ends thereof and to seal the lading in the thusly formed carton and retain the load accommodating body blank in the U-shaped formation.

* * * * *